United States Patent [19]

Giger

[11] 4,122,665

[45] Oct. 31, 1978

[54] METHOD OF MANUFACTURING A PALLET LEVER AND PALLET LEVER MADE BY THIS METHOD

[75] Inventor: Urs Giger, Solothurn, Switzerland

[73] Assignee: ETA A.G. Ebauches-Fabrik, Switzerland

[21] Appl. No.: 703,010

[22] Filed: Jul. 6, 1976

[30] Foreign Application Priority Data

Aug. 5, 1975 [CH] Switzerland ..... 10203/75

[51] Int. Cl.[2] ..... G04B 15/08

[52] U.S. Cl. ..... 58/121 R; 29/177

[58] Field of Search ..... 58/28 D, 59, 79, 116–121; 29/177

[56] References Cited

U.S. PATENT DOCUMENTS

| | | | |
|---|---|---|---|
| 2,663,139 | 12/1953 | Fink | 58/121 R |
| 3,248,783 | 5/1966 | Rietey | 58/121 R |
| 3,335,562 | 8/1967 | Schneider | 58/122 |
| 3,694,885 | 10/1972 | Simon-Vermot | 58/121 X |
| 3,834,155 | 9/1974 | Wuthrich | 58/121 R |

*Primary Examiner*—Robert K. Schaefer
*Assistant Examiner*—Vit W. Miska
*Attorney, Agent, or Firm*—Stevens, Davis, Miller & Mosher

[57] ABSTRACT

A pallet lever which is made by first stamping regions, the surfaces of which will be working surfaces and thereafter blanking out the shape of the lever to dimensions in excess of the area of the stamped portion so that the working surfaces of the stamped portion are protected against surface damage to the blanking out operation.

15 Claims, 4 Drawing Figures

METHOD OF MANUFACTURING A PALLET LEVER AND PALLET LEVER MADE BY THIS METHOD

Figure 1:
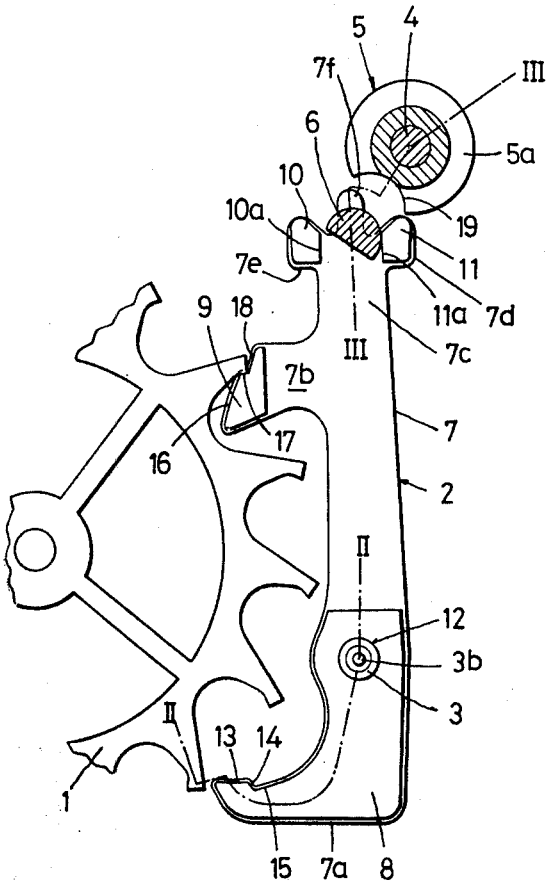

This invention relates to a method of manufacturing a pallet lever for a timepiece movement wherein a lever body is formed in one piece with active elements having functional faces intended to cooperate with an escape wheel and an impulse pin, respectively. The invention further relates to a pallet lever made by this method and comprising a one-piece lever body provided with means for pivoting about an axis.

There are numerous designs already known in the art for pallet levers which are intended to form part of shared-impulse escapements and which comprise a lever body formed in one piece with functional faces acting as impulse planes, locking planes, and entry faces of the fork. Lever bodies of this kind present two sorts of advantages as compared with conventional designs in which pallets of synthetic stone, metal, or plastics are secured to the lever body: for one thing, the inertia of the lever body can be reduced, and for another thing, there is no need to fit the pallets in place as must be done in the case of the classic designs, so that the cost of the lever is reduced. However, is these two advantages are not to be offset by an appreciable decrease in the efficiency, the reliability, or the life of the escapement, it is indispensible that the methods used to produce the one-piece lever body ensure a high-precision result and make it possible to obtain lever bodies having functional faces of sufficiently high quality which are not unduly liable to wear.

It has already been proposed to produce one-piece lever bodies, having all the necessary functional faces, by blanking from a thin metal plate (cf. Swiss Pat. Nos. 340,778 and 332,547). Experience has shown, however, that blanking does not yield a surface quality ensuring satisfactory performance for the impulse and locking planes. Finishing operations, if need be, polishing, or even electrolytic treatments are necessary, so that this known method does not really make it possible to achieve any reduction of the cost-price of the escapement if the requirements for performance are high.

It has likewise been proposed to combine the operations of blanking the lever body with the stamping or bending operations in such a way that the ends of the lever arms project parallel to its axis (cf. German Pat. No. 2,032,622 and German Published Application No. 2,219,028). In this case, the impulse planes may be constituted by elements of surfaces of the laminated plate of which the lever body is formed; but the bending operations do not make it possible to ensure with sufficient accuracy the perpendicularity of the impulse planes with respect to the planes of the lever and of the escape wheel, so that in this case as well, the production of a one-piece lever body is accompanied by an appreciable decrease in efficiency and in dependability.

Furthermore, in these known methods, in order to avoid rapid wear of the functional faces, provision is made for after-treatments for the purpose of forming a hard coating, e.g., a nickel, rhodium, or ruthenium coating, on the surface of the metal. However, this treatment constitutes an additional operation which increases the cost of the lever body.

Franch Pat. No. 378, 909 discloses lever bodies made of sheet steel which are hardened and trued after machining.

Swiss Pat. No. 395,868 mentions the possibility of producing a lever body in one piece with the necessary functional faces by molding or by sintering. However, these techniques do not lend themselves to producing lever bodies which are made of steel or of beryllium bronze, as are the usual lever bodies.

Swiss Pat. Nos. 121,382 and 461,375 described methods of manufacturing lever bodies wherein projecting elements are formed on one of the faces of the lever body by a partial blanking or stamping operation. In the first case, the element is a block intended to bear the dart or guide-pin, while in the second case, the elements are for securing the pallets to the lever. In neither case do the projecting elements comprise functional faces.

Finally, French Pat. No. 1,275,280 relates to a pin-pallet lever in which the pins may be formed in one piece with the lever body. According to this patent, the functional faces of the pins are machined by milling or diamond polishing.

It is an object of this invention to provide a quick and inexpensive method of manufacturing one-piece metal lever bodies having all the necessary functional faces and having a surface of sufficiently high quality and precision to ensure both the reliability of the escapement and a performance comparable to that of escapements utilizing pallet-stones, as well as sufficiently long life.

It is a further object of this invention to provide a method of producing one-piece lever bodies, the impulse faces of which are curved and of differing lengths so as to compensate, by means of a layout which is as correct as possible from the theoretical point of view, for the surface quality of an active element made of metal, which is slightly inferior to that of a sapphire or ruby pallet-stone.

To this end, the method according to the present invention comprises the steps of stamping projecting blocks constituting the active elements in one face of a metal plate and thereafter blanking the lever body along an outline passing outside the contours of the blocks at least at the locations of the functional faces.

In the pallet lever made by this method, the lever body comprises a blanked plate and blocks projecting from one face of this plate, these blocks constituting the active elements, the functional faces of these active elements extending parallel to the pivoting axis of the lever body and being set back from the edge of the plate.

Figure 3:
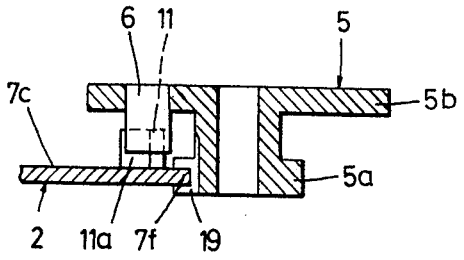
Figure 2:
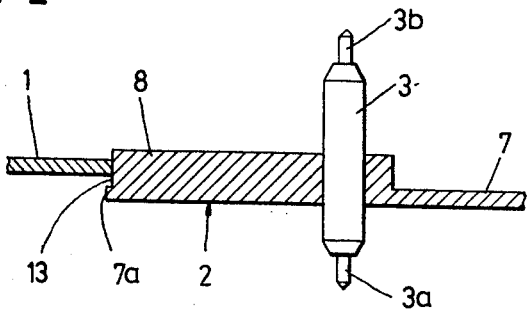
Figure 4:
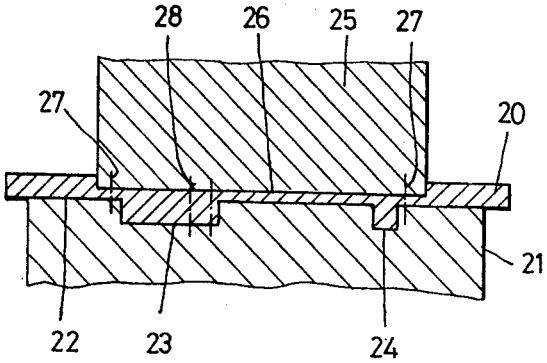

A preferred manner of carrying out the method according to the invention and a pallet lever made by that method will now be described in detail with reference to the accompanying drawings, in which:

FIG. 1 is a top plan view, partially in section, of certain parts of an escapement comprising a pallet lever according to the invention, FIG. 2 is a partial section taken on the line II—II of FIG. 1, FIG. 3 is a partial section taken on the line III—III of FIG. 1, and FIG. 4 is a sectional diagram illustrating a step in the manufacture of the pallet lever of FIG. 1.

The escapement shown in FIG. 1 is an angle escapement. It comprises an escape wheel 1, a pallet lever comprising a body 2 and a staff 3, and a balance of which a staff 4, a double roller 5, and an impulse pin 6 are shown (FIGS. 1 and 3).

The lever body 2 is made in one piece. It comprises an elongated plate 7 and four projecting blocks 8, 9, 10, and 11. The contour of the plate 7 is obtained by blanking. Starting from one end, the plate 7 comprises an exit arm *7a*, an entry arm *7b*, a lever bar *7c*, two lugs *7d* and *7e* forming fork elements and, between the latter, a guide-pin or dart *7f*. The block 8 extends over the whole length of the arm *7a* from the end thereof to a point situated beyond a hole 12 provided for engaging the staff 3. The block 8 is of uniform height throughout its length, and its side faces comprise in particular an exit impulse face 13, a locking plane 14 adjacent to the face 13, and a banking surface 15 adjacent to the plane 14. These three active surfaces, or functional faces, are intended to cooperate with the teeth of the wheel 1 in a manner known per se. It will be noted that they are surfaces having straight generatrices parallel to the axis of the hole 12 and that the impulse face 13 is slightly concave. Its directrix is a curved line. Moreover, the side faces of the block 8 are slightly recessed from the edge of the plate 7.

The surface area of the block 9 is much smaller than that of the block 8. Its height is the same, however, and its side faces are likewise surfaces having straight generatrices parallel to the axis of the hole 12. These surfaces comprise in particular an impulse face 16 having a curved directrix, but slightly convex, the length of which is greater than that of the impulse face 13, a locking plane 17, and a banking surface 18. The active surfaces 16, 17, and 18 cooperate with the teeth of the wheel 1 in the same way as the active surfaces 13, 14, and 15. They are also slightly recessed with respect to the edge of the plate 7.

As may be seen in FIG. 2, the active surfaces of the block 8 extend over a greater height than the thickness of the escape wheel 1, and the teeth of the latter are in contact with the active surfaces of the block 8 approximately midway up. The same applies to the block 9.

The blocks 10 and 11 act as the fork of a conventional pallet lever. They project from the lateral lugs *7e* and *7d* of the plate 7. Their front ends act as horns intended to cooperate with the safety-roller *5a* in order to prevent overbanking, and their inner faces *10a* and *11a* form the two sides of the fork entry. They cooperate with the impulse pin 6. FIG. 1 shows the position of the impulse pin 6 at the moment when the escape wheel 1 is unlocked by the entry locking plane 17, while FIG. 3 shows the fork of the pallet lever at the moment when the impulse pin 6 is situated on the straight line joining the axes of the pallet lever and the balance. In FIG. 1, the balance is rotating counterclockwise.

The plate 7 extends at the level of the safety-roller *5a*, so that the dart *7f* can enter a notch 19. The impulse pin 6 is fixed in the table-roller *5b*. In other respects, the size and arrangement of the double roller 5 are usual. The same applies to the escape wheel 1 which, in the embodiment illustrated, may be manufactured by a known method. In FIG. 1, the pallet lever embraces about 3½ teeth of the escape wheel 1, which has 15 teeth. It will be obvious, however, that this arrangement is not limitative and that any other arc of embracement or any other number of teeth may be chosen as need be.

As stated above, the lever body 2 is driven onto the staff 3, which may be seen in FIG. 2. At the respective ends of the staff 3 are cylindrical pivot-shanks *3a* and *3b* intended to pivot in bearings, one of which will be mounted in the base plate of the movement and the other, for example, in a pallet-cock situated midway between the balance-cock and the base plate. In another embodiment, the pallet-staff might also pivot in a pallet-cock situated at the same level as the wheel-train bridge.

The method by which the lever body 2 is made will now be described. This method comprises a sum total of just two steps, viz., a stamping operation and a blanking operation, which may be carried out in succession by means of a progression swage block comprising tools adapted to the required functions. FIG. 4 illustrates the first operation. The starting material is a metal strip 20 which is placed on a die 21 having a plane upper surface 22 and recesses formed in that surface, such as the recesses 23 and 24, the arrangement and shape of which correspond to the four blocks 8, 9, 10, and 11. The stamping operation is carried out by means of a punch 25 having a plane bottom surface 26 which is lowered vertically towards the die 21 so as to form an impression in the upper surface of the strip 20 and to force material thereof into the recesses 23 and 24. The course of the punch 25 will be so adjusted that the recesses 23 and 24 are completely filled out, but it will be limited so as to avoid any anvil effect which might damage the tooling. Furthermore, the tooling will be designed in such a way that the thickness of material remaining between the upper surface 22 of the die 21 and the bottom surface 26 of the punch 25 when the recesses 23 and 24 have been completely filled corresponds to the desired thickness of the plate 7. This thickness should be sufficient to ensure the rigidity of the lever body 2, but it will be kept to a minimum in order to lighten the lever body 2 and to reduce its moment of inertia.

The sidewalls of the recesses 23 and 24, particularly those intended to form the active surfaces 13, 14, 15, 16, 17, 18, *10a*, and *11a*, will be machined in the die 21 with great care and polished so that the active surfaces formed by contact with them may be used without any touching-up operation. The pallet levers will be finished by polishing in a tumbling-drum.

The second step in manufacturing the body 2 is a blanking operation, for which purpose the strip 20, now provided with the blocks 8 to 11, will be placed on a suitable blanking die facing a blanking punch. The shape of the blanking punch and die will be such that the body 2 leaves this operation cut out along the outline of the plate 7, the hole 12 being pierced during the same operation. In FIG. 4, dot-dash lines 27 indicate the contour boundaries of the plate 7, while reference numeral 28 indicates the location, also shown in dot-dash lines, of the hole 12. It will be seen that the blanking contour passes just outside the side faces of the blocks 8 to 11, so that the blanking operation is carried out without touching the side faces of these blocks, which received their final structure during the stamping operation. On the other hand, the outline of the plate 7 is situated within the limits of the stamping punch, so that the line of blanking is completely contained in the thinned portion of the strip 20. The position of the strip 20 with respect to the blanking die and punch will be so adjusted at the time of the second operation that a rim of substantially uniform width is left around the base of the blocks 8, 9, 10, and 11. This rim may, however, be narrower or even non-existent next to the tips of the blocks 10 and 11, i.e., at the location of the horns of the fork, so that there will be no risk of its hindering the operation of the pallet lever by improperly coming into contact with the edge of the safety-roller *5a* situated at the same level as this part of the lever body 2.

As is usual, the dart *7f* is purely a safety member which normally enters the notch 19 without touching the safety-roller 5a. Consequently, the fact that this part of the pallet lever is produced by a simple blanking operation, without any sort of finishing operation, has no unfavorable effect upon the operation or performance of the escapement.

Thus the lever body 2 may be produced in two steps, starting from the metal strip 20. In the case of a steel body, a hardening operation will also be carried out, followed by polishing in the tumbling-drum, as mentioned above, and tempering.

The pallet lever described above will preferably be made of a steel suitable for stamping. The stamping operation may be carried out either cold or hot. In both cases, the structural transformation of the metal resulting from the stamping operation causes a certain hardening of the surfaces of the stamped blocks. However, other metals capable of being shaped by stamping and blanking, such as beryllium bronze or certain brasses, may likewise be used in the manufacture of the lever body described.

Although FIG. 1 shows an angle escapement in which the angle of lift is limited by the banking surfaces 15 and 18 which cooperate with the tips of the teeth of the escape wheel 1, the method of manufacture described may obviously be applied to pallet levers intended for other types of escapement. Thus a straight pallet lever of conventional shape might also be manufactured as described above. Instead of the blocks 8 and 9 having the banking surfaces 15 and 18, these surfaces might be provided on other blocks projecting from the plate 7, e.g., along the portion forming the lever bar 7c of the pallet lever, these blocks then cooperating with limiting pins fixed in the base plate of the movement, for example. Nor are the arrangement and shape of the impulse faces 13 and 16 shown in FIG. 1 limitative. The blocks 8 and 9 might have impulse planes instead of the curved surfaces 13 and 16, and these planes might be either of the same length or of different lengths.

In the lever body 2 described above, the different dimensions of the blocks 8 and 9 have been selected for a purpose which is not directly related to the actual functions of the escapement. As a matter of fact, these different dimensions are intended solely to give the arm 7a of the pallet lever sufficient mass so that its center of gravity is situated as close as possible to the axis of the hole 12 despite the eccentric arrangement of the block 9 and of the blocks 10 and 11. Moreover, the presence of a block at the location of the hole 12 for the staff 3 increases the length of the hole 12 and consequently facilitates the securing of the staff 3. The height of the blocks 8, 9, 10, and 11 may be determined by taking into account firstly the poising function to be performed by one of the blocks, and secondly the necessity of providing an adequate safety margin in height so that, as may be seen in FIGS. 2 and 3, both the escape wheel 1 and the impulse pin 6 cooperate with the active surfaces of the pallet lever with no risk of coming in contact with the edges of the plate 7.

It follows from the foregoing description that the method to which the present invention relates enables the production of lever bodies by extremely rapid, inexpensive means. However, that is only one of the advantages of the method described. Another is that the functional faces or active surfaces of the lever body, without being corrected, retouched, or expensively finished, exhibit a surface condition which renders them suitable for cooperating under favorable performance conditions with the escape wheel, or with the impulse pin of the balance. An additional advantage derives from the fact that the shapes of the active surfaces of the lever body are determined during fabrication of the stamping die. Hence this shape may be chosen at will without hindrance. Thus the method described makes it possible to produce, at no additional cost, pallet levers having impulse faces which are of different lengths, or which are curved, convexly or concavely, thus enabling their shape to be chosen as a function of the theoretical studies which have been carried out on the layout of escapements with a view to obtaining optimum efficiency. It has long been known, for instance, that it is advantageous to use convex impulse faces on the entry side and concave ones on the exit side. In most cases, however, it has been decided to do without this improvement in practice because the cutting of mineral-material pallets with curved faces represents a complication which makes them prohibitive in cost. The method described makes it possible to produce pallets of any shape at all (pallets of different lengths or having curved impulse faces) without increase in price or difficulty in production. Furthermore, the manufacture of lever bodies by stamping the active surfaces enables an optimum choice of impulse sharing by making the entry and exit impulse faces of different lengths. Finally, still another advantage of the method described is, as already mentioned, that it lends itself to producing pallet levers of any shape and having any of the previously known structural particularities without altering the cost price in any way.

What is claimed is:

1. In a method of manufacturing a pallet lever for a timepiece movement of the type wherein a lever body is formed in one piece with active elements having functional faces intended to cooperate with an escape wheel and an impulse pin, respectively, the improvement comprising the steps of:

forming from a plane metal plate by stamping, a plurality of blocks projecting from one plane face of that plate, and constituting active elements, and, thereafter blanking said lever body along an outline passing outside the contours of said blocks at least at the locations of the functional faces thereof.

2. A method in accordance with claim 1, further comprising the steps of blanking in said lever body a hole having an axis coinciding with the pivoting axis of said pallet lever, and securing a pallet-staff in said hole.

3. A method in accordance with claim 2, wherein said hole is blanked simultaneously with said lever body.

4. A method in accordance with claim 2, wherein a said projecting block is stamped at the location of said hole, said hole being blanked in said block.

5. A method in accordance with claim 1, wherein said stamping step is carried out between a flat punch and a die having hollows in the shapes of said blocks, and said blanking takes place along an outline situated within the limits of said punch.

6. A timepiece pallet lever comprising a one-piece lever body provided with means for pivoting about an axis, said lever body comprising a blanked plate and blocks stamped to project from one face of said plate, said blocks constituting active elements having functional faces, said functional faces of said active elements extending parallel to said pivoting axis of said lever body and being set back from the edge of said plate.

7. A pallet lever in accordance with claim 6, wherein said lever body comprises four said projecting blocks, two of said blocks each having an impulse face and a locking plane, and the other two said blocks each having an entry face for said impulse pin and a surface for preventing overbanking.

8. A pallet lever in accordance with claim 7, wherein said two blocks each having a said impulse face each further comprise a banking surface situated adjacent to said locking plane for limiting the angle of lift of said pallet lever and cooperating with the teeth of said escape wheel.

9. A pallet lever in accordance with claim 6, wherein said functional faces comprise two plane impulse faces parallel to the axis of said pallet lever.

10. A pallet lever in accordance with claim 6, wherein said functional faces comprise two impulse faces which are surfaces having straight generatrices and a curved directrix, said generatrices being parallel to the axis of said pallet lever.

11. A pallet lever in accordance with claim 10, wherein the entry-side said impulse face is convex and the exit-side said impulse face is concave.

12. A pallet lever in accordance with claim 10, wherein the lengths of said impulses faces, measured along said directrix, are different from one another.

13. A pallet lever in accordance with claim 11, wherein the lengths of said impulse faces, measured along said directrix, are different from one another.

14. A pallet lever in accordance with claim 6, wherein said plate is blanked with a finger intended to function as a dart.

15. A pallet lever in accordance with claim 6, wherein the volumes of said blocks are such that the center of gravity of said lever body is situated substantially at said pivoting axis.

* * * * *